US008180203B2

(12) United States Patent
Kurano

(10) Patent No.: US 8,180,203 B2
(45) Date of Patent: May 15, 2012

(54) DIRECT HEATING TUBE AND METHOD OF HEATING FLUID USING SAME

(75) Inventor: Mitsuhiro Kurano, Saitama (JP)

(73) Assignee: GL Sciences Incorporated, Tokyo (JP)

( * ) Notice: Subject to any disclaimer, the term of this patent is extended or adjusted under 35 U.S.C. 154(b) by 603 days.

(21) Appl. No.: 10/597,953

(22) PCT Filed: Feb. 13, 2004

(86) PCT No.: PCT/JP2004/001564
§ 371 (c)(1),
(2), (4) Date: Sep. 12, 2006

(87) PCT Pub. No.: WO2005/078354
PCT Pub. Date: Aug. 25, 2005

(65) Prior Publication Data
US 2007/0107675 A1 May 17, 2007

(51) Int. Cl.
*H05B 3/60* (2006.01)

(52) U.S. Cl. ..... 392/311; 392/312

(58) Field of Classification Search ..... 392/311, 392/312–338; 122/408.1–411, 13.01–19.2
See application file for complete search history.

(56) References Cited

U.S. PATENT DOCUMENTS

| | | | | |
|---|---|---|---|---|
| 4,650,964 | A | 3/1987 | Vincent | |
| 4,661,684 | A * | 4/1987 | Sellers | 392/308 |
| 4,974,551 | A * | 12/1990 | Nelson | 122/19.2 |
| 5,006,689 | A * | 4/1991 | Kurachi et al. | 392/450 |
| 5,096,471 | A | 3/1992 | Sacks et al. | |
| 5,271,086 | A | 12/1993 | Kamiyama et al. | |
| 5,563,352 | A * | 10/1996 | Helmig | 73/863.12 |

FOREIGN PATENT DOCUMENTS

| | | | |
|---|---|---|---|
| DE | 3810624 | A1 | 10/1989 |
| DE | 4201944 | A1 | 8/1992 |
| DE | 4226767 | C1 | 9/1993 |
| GB | 1204897 | A | 9/1970 |
| GB | 1482464 | A | 8/1977 |
| JP | 55-132500 | | 10/1980 |
| JP | 60-198457 | | 10/1985 |
| JP | 5-502734 | | 5/1993 |
| JP | 6-222048 | | 8/1994 |
| WO | 98/07505 | * | 2/1998 |

OTHER PUBLICATIONS

EP 04 71 0997 Supplementary European Search Report dated Jan. 3, 2011.

* cited by examiner

*Primary Examiner* — Daniel L Robinson
(74) *Attorney, Agent, or Firm* — Hahn Loeser & Parks LLP; John J. Cunniff

(57) ABSTRACT

Provided is a direct heating tube which has a sufficient heating rate and a sufficient cooling rate, and has no cold spots therein, making it possible to ensure a uniform temperature distribution in the whole part thereof or a temperature distribution having a desired temperature gradient, and making it possible to keep constant the temperature of a fluid which is caused to flow through the tube or to give a desired change to the temperature of the fluid. Provided also is a direct heating tube which does not exert an adverse influence on devices near the tube, such as a detector and an oven, even by heating the tube. In a desired portion of the tube to be heated, a second heated tube connected to a first heated tube is provided outside the first heated tube, and an electrode portion is connected to the second heated tube.

20 Claims, 9 Drawing Sheets

DIRECT HEATING TUBE AND METHOD OF HEATING FLUID USING SAME

TECHNICAL FIELD

The present invention relates to a direct heating tube which heats a fluid by heating the tube during the passage of fluids such as liquids and gases. More particularly, it relates to a direct heating tube which is directly heated by connecting an electrode to the tube and causing a DC current or an AC current to flow directly in the tube, such as a column which is heated in a gas chromatograph, a heat tube (a transfer line) for keeping warm a column to introduce samples from an analysis column to an ionization chamber in a heated tube at a sample injection port of a gas chromatograph or a gas chromatograph-mass spectrometer (GC/MS), and a heated tube which is used to introduce samples from the column of a gas chromatograph into a detector, such as a hydrogen flame ionization detector (FID).

BACKGROUND ART

In a gas chromatograph, before the introduction of a sample into a separation column which performs the separation of components, it is general practice to concentrate the sample by use of a capillary column or a packed column and to increase the analysis sensitivity of a component to be analyzed. In the introduction of a sample into a gas chromatograph, the cold on-column injection method and the programmed temperature vaporization method (the PTV method) are used. In a case where a gas chromatograph-mass spectrometer (GC/MS) is used or in a case where a detector, such as a hydrogen flame ionization detector (FID), is used as the detector of a gas chromatograph, in a case where in introducing components which have eluted from an analysis column into the ionization chamber of a mass spectrograph or the hydrogen flame portion of a hydrogen flame ionization detector, and in a case where a gaseous sample and the like are transferred to keep the column warm, it is general practice to use a tube which is heated so that the condensation of the gas does not occur, i.e., a heat tube.

As methods of concentrating and collecting samples in a gas chromatograph, there are available a method which involves feeding a sample into a packed column which is packed with a filler which selectively adsorbs and collects a component to be analyzed in a sample, causing the filler to adsorb and collect the component to be analyzed, and heating thereafter the column, thereby causing the component to be analyzed to be desorbed from the filler, a method which involves feeding a sample into a cooled column, aggregating the component to be analyzed in the sample by causing the component to be adsorbed and condensed on an inner wall of the column, and heating the column thereafter, whereby the component to be analyzed is vaporized and desorbed at a high speed, and the like.

And as methods of heating this column, there are available, for example, first as shown in FIG. 11, a method which involves winding an insulated heater tube 90 like a sheathed heater directly on a tube 91 to be heated (hereinafter briefly called a tube 91), such as a column, thereby to heat the tube, second as shown in FIG. 12, a method which involves using a double construction tube consisting of a tube 91 and an outer tube 92 formed around this tube and heating the tube by introducing a high-temperature gas, such as the heated air, into the space formed between the outer tube 92 and the tube 91, third as shown in FIG. 13, which involves using a direct heating tube, by which electrodes 93, 93 are provided at both ends of a tube 91 and the tube 91 is heated by causing a DC current or an AC current to flow directly through the tube 91, and fourth as shown in FIG. 14, a method which involves inserting a heater 95 and a sensor 96 along with a tube 91 into a heating block 94 made of aluminum, brass and the like and performing heating, whereby the inserted tube 91 is heated and the temperature of the tube is kept, these methods being disclosed for example in Japanese Patent Laid-open No. Heisei 5-502734 and Japanese Patent Laid-Open No. 6-222048.

Heating methods of tube similar to those given above are used also in a case where a gas chromatograph-mass spectrometer (GC/MS) is used or in a case where a detector, such as a hydrogen flame ionization detector (FID), is used, in a heat tube which is used in the transfer of a sample from the column of the gas chromatogram to the mass spectrometer and to the detector, such as a hydrogen flame ionization detector (FID), or in a column and a vaporization chamber in various methods of introducing samples of a gas chromatograph.

However, these conventional methods of heating a column, a heat tube and the like have had the following problems. Although the first method can be very easily carried out, for example, when as in the case of a cryotrap used in a gas chromatograph, cooling and heating are alternately performed and the temperature change of the cryotrap is severe, the electrical insulation of a heater may sometimes be broken, thus involving risk. Therefore, it is necessary to select and use a heater having a sufficient insulation distance and safe watt density in terms of design, with the result that the rate at which the tube is heated may not be sufficient. As shown in FIG. 15, this heating rate has a great effect on the shape of a chromatogram peak. That is, the higher the temperature rise rate, the narrower the sample band, thereby making it possible to detect the sample with high sensitivity, and the lower the temperature rise rate, the wider the sample band, thereby making it impossible to detect the sample with high sensitivity.

Also the second method has the greatest weak point that the heating rate is low in the same manner as the first method. The reason is as follows. That is, because the specific heat capacity of gases is very small, it is necessary to cause a large volume of a high-temperature gas to flow at a time if rapid heating is required. However, in order to realize this, large-scale equipment becomes necessary and the manufacturing cost also rises.

In the third method, very high heating rates can be obtained by causing a current to flow directly through a tube 91 without the use of a heater. However, in the conventional direct heating method, heat mass is present in electrode portions at both ends and, therefore, this poses the problem that there are low-temperature areas, which are what is called cold spots, in both end portions. In order to avoid cold spots, there have thitherto been adopted measures such as adding heating portions in both ends to keep warm the temperature of the two ends. In connecting the electrodes 93 to a power supply section, materials having small electric resistance, such as nickel wires and copper wires, are used. In order to minimize the heat mass of the electrodes 93, very complicated assembling has been performed; for example, electric wires are welded or brazed directly to the tube.

The fourth method can be performed very easily and is often used in the sample introduction portion of a gas chromatograph. However, much time is required before the sample introduction portion is heated because of a large thermal capacity and inversely when cooling is performed, much time is required. Therefore, this fourth method is in adaptable to the cold injection method, which has recently begun to be frequently used. When used in the introduction portion to a detector, such as a hydrogen flame ionization detector, it is desirable that a collector portion be in a cooled condition. However, when the fourth method is used, even the collector portion is heated, and the oven of a gas chromatogram is also heated. Thus, the fourth method has exerted an undesirable influence on a detector, an oven and the like.

Therefore, in order to solve the above-described conventional problems, it is an aspect of the present invention to provide a direct heating tube which has a sufficient heating rate and a sufficient cooling rate, and has no cold spots therein, making it possible to ensure a uniform temperature distribution in the whole part thereof or a temperature distribution having a desired temperature gradient, and making it possible to keep constant the temperature of a fluid which is caused to flow through the tube or to give a desired change to the temperature of the fluid. Also, the present invention has as an aspect the provision of a direct heating tube which does not exert an adverse influence on devices near the tube, such as a detector and an oven, even by heating the tube, and a direct heating tube of simple construction which is capable of being manufactured at low cost. Also, the present invention has as its object the provision of a direct heating tube which permits designs in which the ease of assembling is considered for an electrode portion. Furthermore, the present invention has an object to provide a heating method which keeps constant the temperature of a fluid which is caused to flow through a tube or gives a desired change to the temperature of the fluid.

DISCLOSURE OF THE INVENTION

In a first aspect to solve the above-described problems, there is provided a direct heating tube which directly heats a fluid during the passage of the fluid, which is characterized in that in a desired portion of the tube to be heated, a second heated tube which is connected to a first heated tube is provided outside the first heated tube.

A second aspect provides a direct heating tube according to the first aspect, characterized in that the second heated tube is provided along a full length of the desired portion of the direct heating tube to be heated.

A third aspect provides a direct heating tube according to the first aspect, characterized in that the second heated tube is provided in both end portions of the desired portion of the direct heating tube to be heated.

A fourth aspect provides a direct heating tube according to the first aspect, characterized in that the second heated tube is provided in one end portion of the desired portion of the direct heating tube to be heated.

A fifth aspect provides a direct heating tube according to any one of the first to fourth aspects, characterized in that an electrode portion is connected to the second heated tube.

A sixth aspect provides a direct heating tube according to the fifth aspects, characterized in that an electrode portion is connected directly to the second heated tube.

A seventh aspect provides a direct heating tube according to any one of the first to sixth aspects, characterized in that a change in gradient is provided in a wall thickness of the first heated tube and/or the second heated tube.

An eighth aspect provides a direct heating tube according to any one of the first to seventh aspects, characterized in that the direct heating tube is a column or a heat tube.

A ninth aspect provides is a method of heating a fluid passing through a tube, wherein in a desired portion of the tube to be heated, by use of a direct heating tube which is constructed in such a manner that a second heated tube connected to a first heated tube is provided outside the first heated tube, a fluid passing through the tube is heated by connecting an electrode portion to the second heated tube and heating the first heated tube.

According to the present invention described above, the direct heating tube has a sufficient heating rate and a sufficient cooling rate, and has no cold spots therein, with the result that it has become possible to ensure a uniform temperature distribution in the whole part thereof and a temperature distribution having a desired temperature gradient, and that it has become possible to keep constant the temperature of a fluid which is caused to flow through the tube or to give a desired change to the temperature of the fluid. When heated, the direct heating tube does not exert an adverse influence any more on devices near the tube, such as a detector and an oven, even by heating the tube. Furthermore, the direct heating tube could be given a simple construction which is capable of being manufactured at low cost. And designs in which the ease of assembling is considered became possible for an electrode portion of the direct heating tube.

BEST MODE FOR CARRYING OUT THE INVENTION

Figure 1:
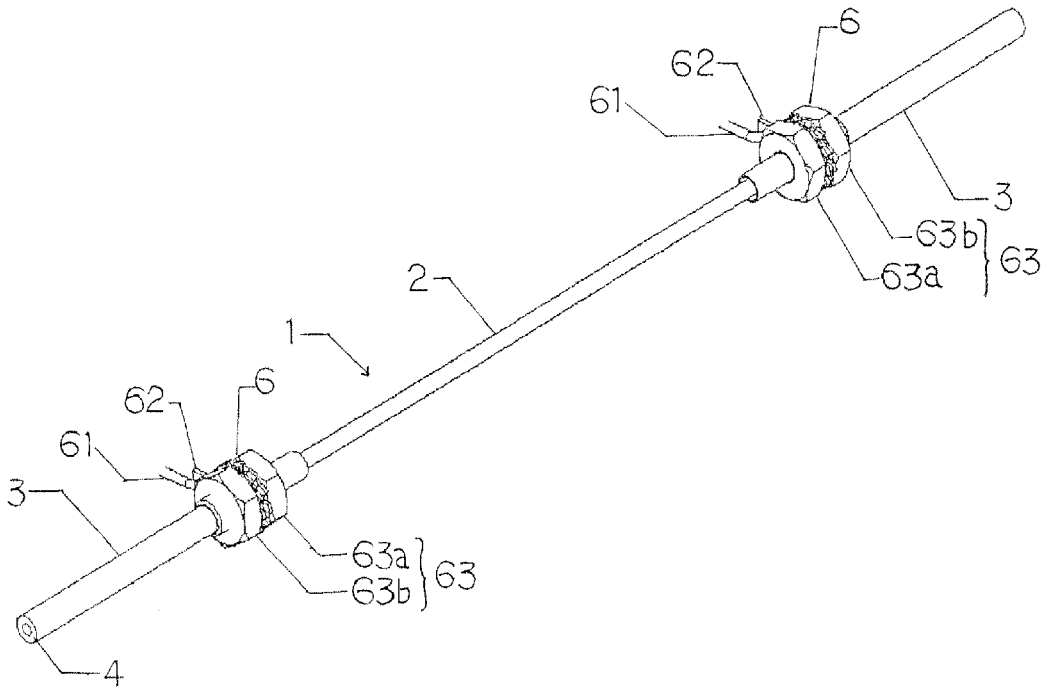
FIG. 1 is a perspective view of an embodiment of the present invention.
Figure 2:
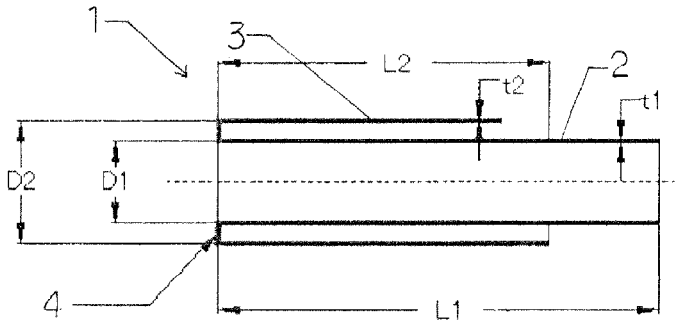
FIG. 2 is a sectional view of another embodiment of the present invention.

The best mode for carrying out the present invention will be described below with reference to the drawings. A direct heating tube 1 (hereinafter simply referred to as a tube 1) is constituted by a first cylindrical heated tube 2 and second cylindrical heated tubes 3, 3, which are provided outside the first heated tube 2. The second heated tubes 3, 3 are formed toward the center part of the first heated tube 2 with an appropriate length from end portions of flanges 4, 4 which are implanted in a standing manner perpendicularly to the first heated tube 2 and radially outward from both ends of the first heated tube 2, and the side surface of the second heated tube 3 is parallel to the side surface of the first heated tube 2, that is, the second heated tube 3 is provided outside the first heated tube 2 concentrically with the first heated tube 2. In this manner the places of the tube 1 where the second heated tubes 3 are provided have a double tube construction.

The tube 1 is used as a packed column, various kinds of columns, such as a capillary column which is coated or filled with a stationary phase or in which a stationary phase is packed, or a heat tube, a transfer line between the gas chromatograph of a gas chromatograph-mass spectrometer and the mass spectrometer, and other various kinds of direct heating tubes which require heating. There are two types of tube 1; one is a type in which a fluid to be heated is caused to pass directly through the first heated tube 2 and the other type is such that a separate tube through which a fluid to be heated is caused to pass is installed within the first heated tube 2. Materials for the tube 1 depend on uses of the tube 1 and service temperature ranges suited to the uses, and are mainly metals, such as copper, aluminum and stainless steel, and their alloys. Heat resistant metals or stainless steel are suitable for many uses. However, it is also possible to use electrically conductive ceramics and electrically conductive polymers. The total length of the tube 1 is not especially limited and is determined according to uses of the tube 1. However, tubes 1 having lengths in the range of approximately 10 to 500 mm are mainly used.

Although it is desirable that the second heated tube 3 and the flange 4 be fabricated from the same material as the first heated tube 2, it is also possible to use other materials which are good conductors of electricity and have high thermal conductivity. It is also desirable that usually, connections between the first heated tube 2 and the second heated tubes 3 have a minimum of heat mass.

The first heated tube 2 corresponds to a conventional direct heating tube itself, and the second heated tube 3 is provided in order to keep constant the temperature distribution within the first heated tube 2 in a desired portion of the tube 1 to be heated or in order to ensure a temperature distribution having a desired temperature gradient. That is, the second heated tube 3 is such that by being energized from an electrode portion 6 provided in the second heated tube 3, the second heated tube 3 applies power to and heat the first heated tube 2 and, at the same time, the second heated tube 3 itself is heated and radiates heat. Thus, the second heated tube 3 has the function of heating the first heated tube 2 by its radiation heat. The desired portion to be heated refers to a range to be heated within the first heated tube 2 in the total length of the tube 1, and there are two cases of the desired portion to be heated; in one case, the desired portion to be heated covers the total length of the tube 1 and in the other case, the desired portion to be heated is part of the total length of the tube 1.

The second heated tube 3 is provided in at least part of a desired portion of the tube 1 to be heated thereby to give an appropriate range of the desired portion to be heated a double tube construction. For installation modes of the second heated tube 3, in the case where the total length of the tube 1 is a desired portion to be heated, as described above, the second heated tubes 3, 3 are provided in both end portions of the first heated tube 2 and besides, it is also possible to adopt a double tube construction by installing one second heated tube 3 whose both ends are connected to the first heated tube 2 along the full length of the first heated tube 2, thereby to give a double tube construction to the full length of the tube 1. In the case where part of the tube 1 is a desired portion to be heated, the second heated tubes 3, 3 are provided in an extending manner toward the center from both ends of the first heated tube 2 in a desired portion to be heated thereby to give a double tube construction to an appropriate range of the tube 1, or it is also possible to install one second heated tube 3, which is connected to both ends of a desired portion to be heated, along the desired portion to be heated, thereby to give a double tube construction to the full length of the desired portion to be heated. Furthermore, in a case where a desired heating temperature is maintained in one end portion of a desired portion of the tube 1 to be heated and the other end portion is allowed to have a temperature lower than the desired heating temperature, it is also possible to install the second heated tube 3 only at one end of the desired portion of the tube 1 to be heated where the desired heating temperature is to be maintained.

The flange 4 is a member to connect the second heated tube 3 to the first heated tube 2. Incidentally, if the flange 4 fixes the second heated tube 3 to the first heated tube 2 and, at the same time, can be held outside the first heated tube 2 at an appropriate distance, then the direction of implantation of the flange 4 in a standing manner is not limited. It is not always necessary to connect the first heated tube 2 or the second heated tube 3 to an end portion of the flange 4, and the first heated tube 2 or the second heated tube 3 may be connected to an appropriate place of the flange 4. The flange 4 is annular and has a wall thickness which is equal to that of the first heated tube 2 or the second heated tube 3. It is also possible to give an appropriate thickness to the flange 4, and members which are used to connect the tube 1 and a column and the like, such as a column connection port, may also be used as the flange. Furthermore, the second heated tube 3 may be connected directly to the first heated tube 2 by welding and the like without using the flange 4.

The total length of the tube 1, i.e., the first heated tube 2 is not especially limited, and is determined according to its use. However, tubes having lengths in the range of approximately 10 to 500 mm are used. The total length of the second heated tube 3 is not especially limited. However, this length is set according to a required temperature gradient within the first heated tube 2, and it is possible to set this length in the range of 0 mm to the total length of the first heated tube 2. Here "0 mm" means a case where the second heated tube 3 is provided only in one end portion of a desired portion of the tube 1 to be heated and the second heated tube 3 is not provided in the other end portion or a case where the second heated tube 3 is provided in one end portion of a desired portion of the tube 1 to be heated and only the flange 4 is provided in the other end portion, whereby an electrode is connected to the flange 4.

The diameter D1 of the first heated tube 2 is not especially limited and can be appropriately designed according to uses of the first heated tube 2, and tubes 2 having diameters D1 in the range of approximately 0.5 to 25 mm are used. The diameter D2 of the second heated tube 3 is not especially limited so long as it is larger than the diameter 1 of the first heated tube 2. Usually, the diameter D2 of the second heated tube 3 depends on the diameter of the first heated tube 2. That is, the diameter of the second heated tube 3 is found by $D2=D1+\Delta D$, and it is appropriate to set $\Delta D$ in the range of approximately 1 to 10 mm. The distance between the first heated tube 2 and the second heated tube 3 is $\frac{1}{2}\Delta D$. Of course $\Delta D$ is not limited to this range, and it is possible to adopt appropriate values according to external factors, such as the power supply capacity required for heating, a temperature sensor installed in the heated tube and a cooling mechanism installed in the heated tube. Incidentally, $\Delta D$ does not take a fixed value in a case where the second heated tube 3 is installed directly on the first heated tube 2 without the use of a flange and in a case where a change in gradient is given to the wall thickness of the first heated tube 2 or/and the second heated tube 3.

The wall thickness t1 of the first heated tube 2 and the wall thickness t2 of the second heated tube 3 are not especially limited and it is preferred that wall thickness t1 of the first heated tube 2 and the wall thickness t2 of the second heated tube 3 be in the range of about 0.05 to 0.5 mm, although they depend on materials used. Incidentally, the wall thickness t1 of the first heated tube 2 and the wall thickness t2 of the second heated tube 3 also depend on the power supply capacity used in heating. The wall thickness t1 of the first heated tube 2 and the wall thickness t2 of the second heated tube 3 may have a gradient change in wall thickness in order to make the temperature gradient uniform or in order to obtain an arbitrary temperature gradient, and are not a uniform thickness respectively along the full length of the first heated tube 2 and the second heated tube 3. The wall thickness t1 of the first heated tube 2 and the wall thickness t2 of the second heated tube 3 may be the same wall thickness, but the two may also be different from each other. Of course, it is necessary that the total length and wall thickness t2 of the second heated tube 3 be in such a range that the second heated tube 3 radiates heat due to the power supply capacity used in heating and can heat the first heated tube 2 by the radiation heat of the second heated tube 3.

And by appropriately adjusting the total length, diameter and wall thickness of the first heated tube 2 and the second heated tube 3, it is possible to set the temperature gradient within the first heated tube 2 at an arbitrary value by the existence or nonexistence of the flange 4 and by the installation position of the electrode portion 6. The shape of the first heated tube 2 and the second heated tube 3 is not limited to a cylindrical shape, and the first heated tube 2 and the second heated tube 3 may be formed to have a section which is an elliptical shape, a square, other polygons and the like. The first heated tube 2 and the second heated tube 3 may have different sections. Although it is desirable that at various points of the tube 1, the second heated tube 3 be installed concentrically with the first heated tube 2 or with the same distance between the second heated tube 3 and the first heated tube 2, it is not always necessary that the second heated tube 3 be installed concentrically or with the same distance.

The electrode portion 6 is provided outside the second heated tube 3. The connection between the electrode portion 6 and a power supply section 69 is not especially limited. However, it is desirable to use a conductor 61 and to use materials of small electric resistance, such as a nickel wire and a copper wire. In the case of direct heating of a conventional single tube, the assembling of the electrode portion has been very complicated, for example, an electric wire is welded or brazed directly to the tube in order to minimize the heat mass of the electrode portion. However, according to the present invention, it is unnecessary to consider the heat mass of the electrode portion 6 and, therefore, designs in which importance is attached to the ease of assembling are possible. Therefore, it is possible to adopt appropriate installation methods of the electrode portion 6, which include not only a method by which an electric wire is welded or brazed directly to the second heated tube 3, but also a method which involves connecting the conductor 61 to an electrode plate 62 having a hole through which the second heated tube 3 can be inserted, inserting the second heated tube 3 through the electrode plate 62, and fixing the electrode plate 62 by use of a double nut 63 constituted by nuts 63*a*, 63 and the like, or a method which involves winding the conductor 61 on the second heated tube 3 and fixing the conductor 61 by supporting the conductor 61 from both sides thereof by use of the double nut 63.

The electrode portion 6 is installed directly on the second heated tube 3 or may be installed on an electrically conductive flange connected to the second heated tube 3, and the like. When the second heated tube 3 is provided only at one end of a desired portion to be heated, the electrode portion 6 at the other end is installed directly on the first heated tube 2 or may be installed on a flange connected to the first heated tube 2, and the like.

Figure 3:
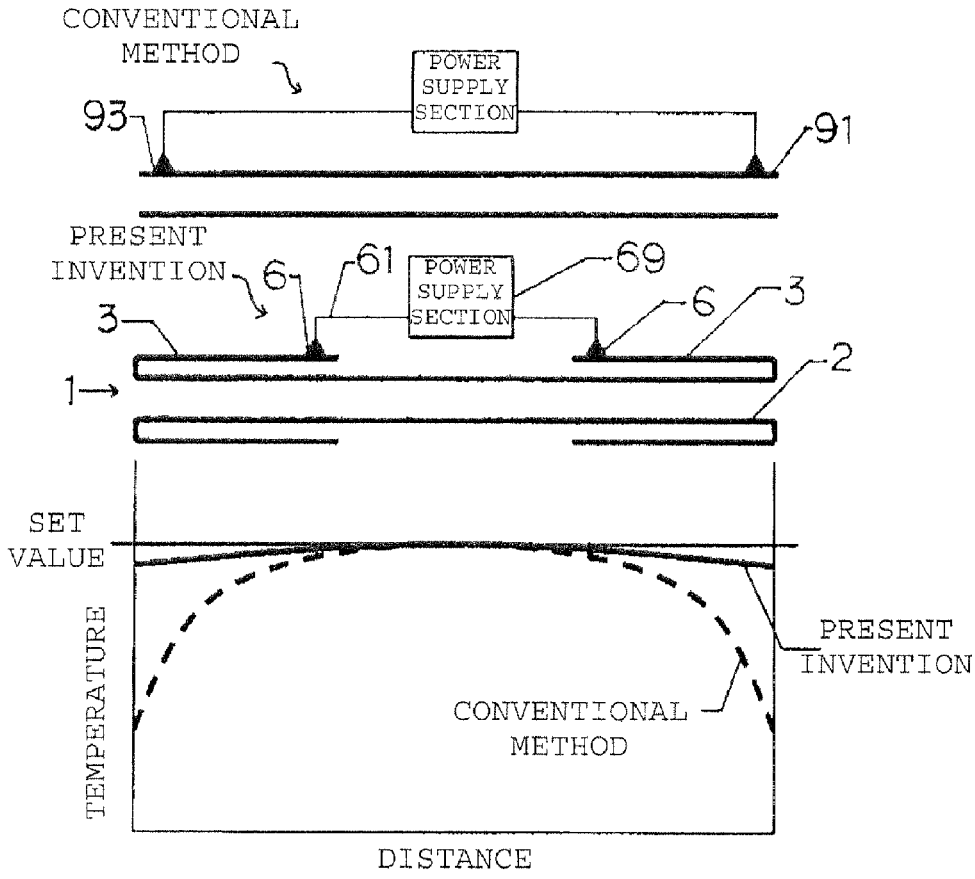
FIG. 3 is a schematic diagram showing a difference in effect between the present invention and a conventional method.

By giving the tube 1 a double tube construction like this and providing the electrode portion 6 on the second heated tube 3, it is ensured that the action of radiation heat works between the second heated tube 3 and the first heated tube 2 and it becomes possible to prevent a temperature drop of the first heated tube 2 resulting from losses in the heat mass in the electrode portion 6. As a result, as is apparent from the temperature distribution within the first heated tube 2 shown in FIG. 3, in a conventional example in which the electrode portions are provided directly on the heated tube, the temperature at the end portions of the tube where the electrodes are provided is substantially low compared to a set value, whereas in the tube of double construction of the present invention, the temperature in the end portions of the tube substantially shows the set value and it becomes possible for the temperature to show a uniform temperature distribution through the whole tube.

Figure 4:
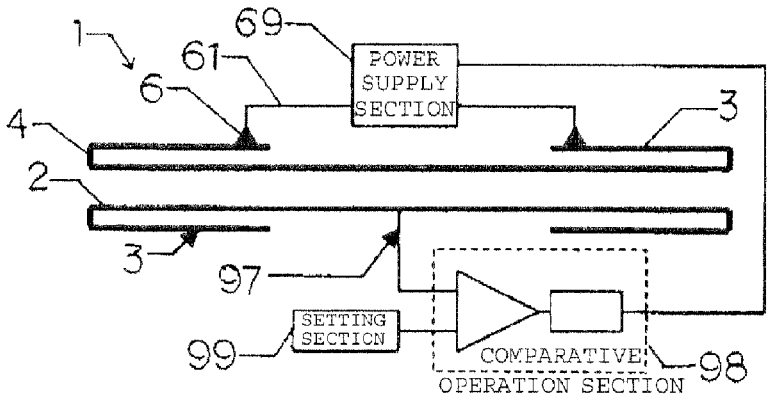
FIG. 4 is a conceptual diagram of an embodiment of the present invention.

Incidentally, as shown in FIG. 4, in the tube 1, a temperature sensor 97 provided on the first heated tube 2 as with a conventional direct heating tube is connected to a comparative operation section 98, a desired heating temperature within the tube which is set beforehand in a setting section 99 and temperature information from the temperature sensor 97 are treated in the comparative operation section 98, feedback control is performed in the power supply section 69, and the temperature of a desired portion of the tube 1 to be heated is adjusted.

EMBODIMENTS

Embodiments of the tube 1 having the double tube construction of the present invention will be described below with reference to the drawings.

Embodiment 1

Figure 5:
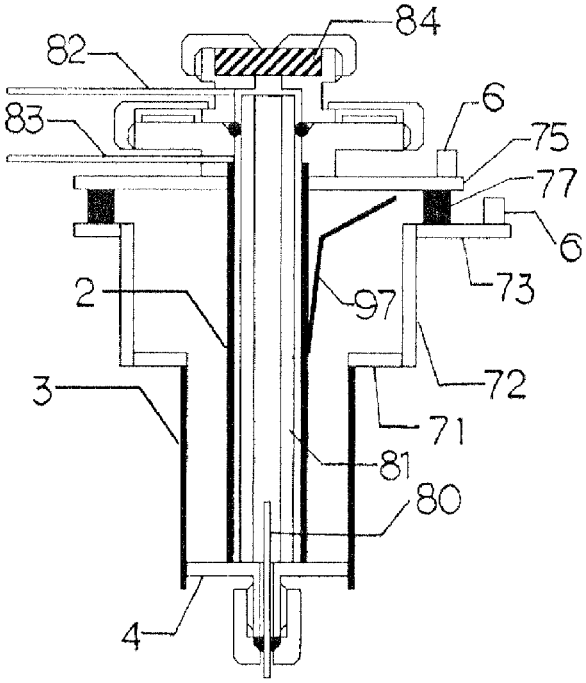
FIG. 5 is a longitudinal sectional view of embodiment 1 of the present invention.

FIG. 5 is a longitudinal sectional view of an embodiment in which a direct heating tube 1 of the present invention is used in a sample introduction portion of a gas chromatogram. A first heated tube 2 constitutes a sample vaporization portion, a flange 4 is implanted in a standing manner radially from a lower end of the first heated tube 2, and a second heated tube 3 is installed at a peripheral end of the annular flange 4 made of a sheet to the roughly middle point of the first heated tube 2 concentrically with the first heated tube 2. As with the sample introduction portion of a usual gas chromatogram, this sample introduction portion is constituted by a column 80, a liner 81, a carrier gas line 82, a discharge line 83, a septum 84 and the like. The first heated tube 2 and the second heated tube 3 and the flange 4 are assembled by welding. A flange 71 is provided in an upper end portion of the second heated tube 3, a tube 72 is provided at a peripheral end of the flange 71, a flange 73 is provided in an upper end portion of the tube 72, and an electrode portion 6 is provided on the flange 73. Furthermore, a flange 75 which is implanted in a standing manner perpendicularly and radially from the first heated tube 2 is provided in an upper end portion of the first heated tube 2, and an electrode portion 6 is provided in the flange 75. The outside diameter of the first heated tube 2 is 6.350 mm, the wall thickness is 0.152 mm, and the length is 72 mm. The outside diameter of the second heated tube 3 is 9.525 mm, the wall thickness is 0.152 mm, and the length is 29 mm. Both tubes are made of stainless steel. The wall thickness of the flange 4, the flange 71, the tube 72, the flange 73 and the flange 75 is 0.5 mm, and they are made of stainless steel.

Figure 6:
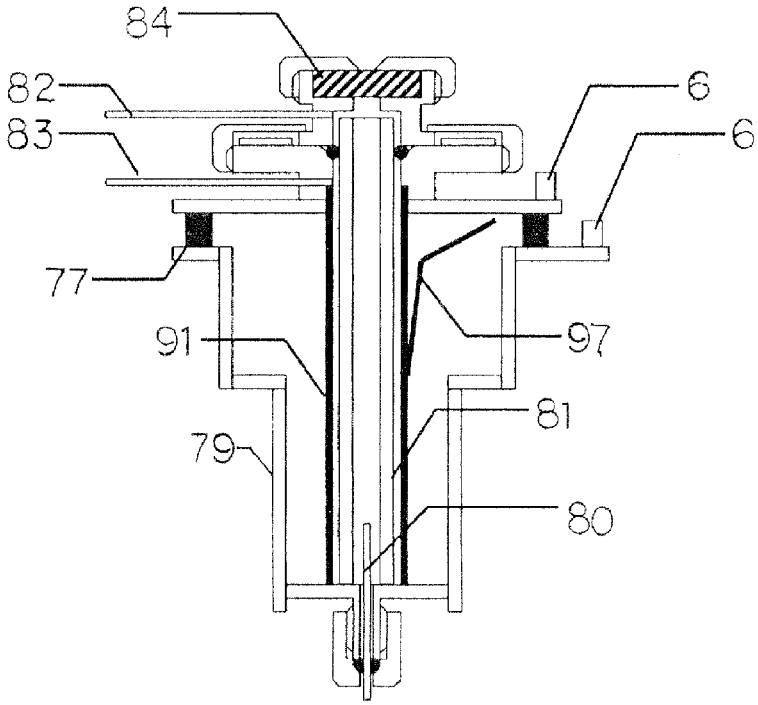
FIG. 6 is a longitudinal sectional view of a comparative example for Embodiment 1 of the present invention.
Figure 7:
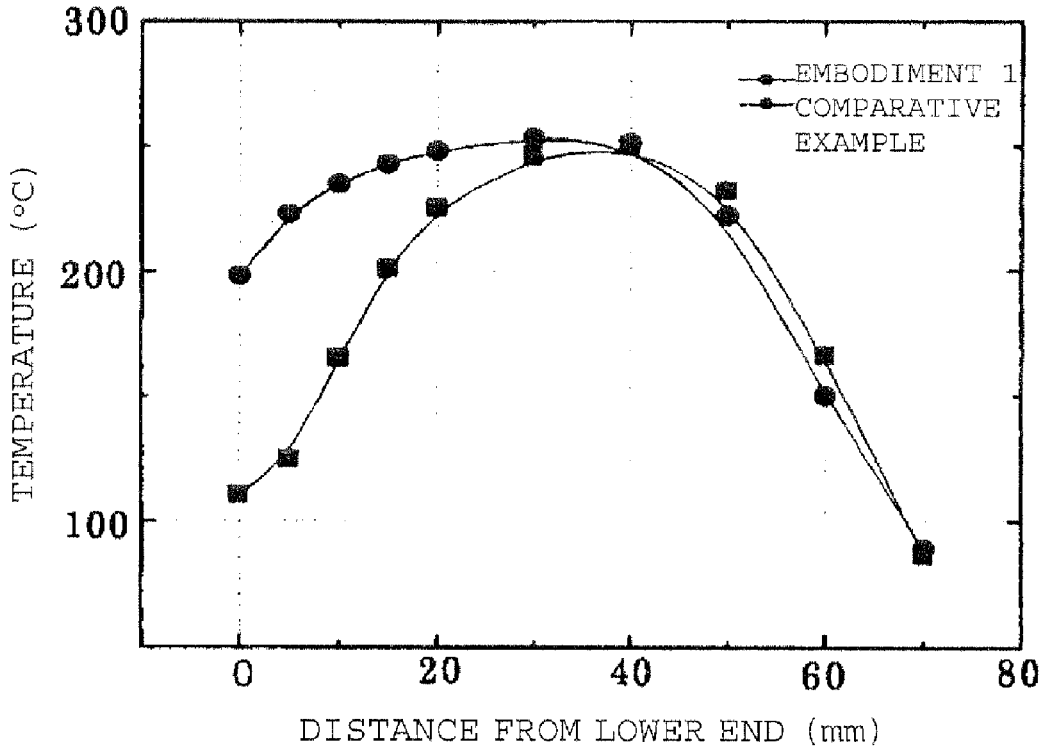
FIG. 7 is a graph showing a difference in effect between Embodiment 1 of the present invention and the comparative example.

As a comparative example for this Embodiment 1, as shown in FIG. 6, a usual outer tube 79 which is not a heated tube, i.e., a tube which has not the capacity to heat a tube 91 to be heated by heat generation and radiation, has a wall thickness of 0.5 mm and is made of stainless steel, is provided outside the tube 91 to be heated in place of the second heated tube 3 of Embodiment 1, and a sample introduction portion in which an electrode portion 6 is connected to the outer tube 79 is formed. The temperature distribution in the tubes of Embodiment 1 and the comparative example was measured by using the sample introduction portion. The result of the measurement is shown in FIG. 7, As is apparent from FIG. 7, in the portion where the second heated tube 3 is provided, an extreme temperature drop as observed in the comparative example in which the second heated tube 3 is not provided dose not occur although a small temperature drop is observed at the lower end, and an almost uniform temperature distribution in the range of 10 to 40 mm from the lower end of the tube 1 is observed. On the other hand, in the single tube of the comparative example, a remarkable change is observed in the temperature distribution.

Embodiment 2

Figure 8:
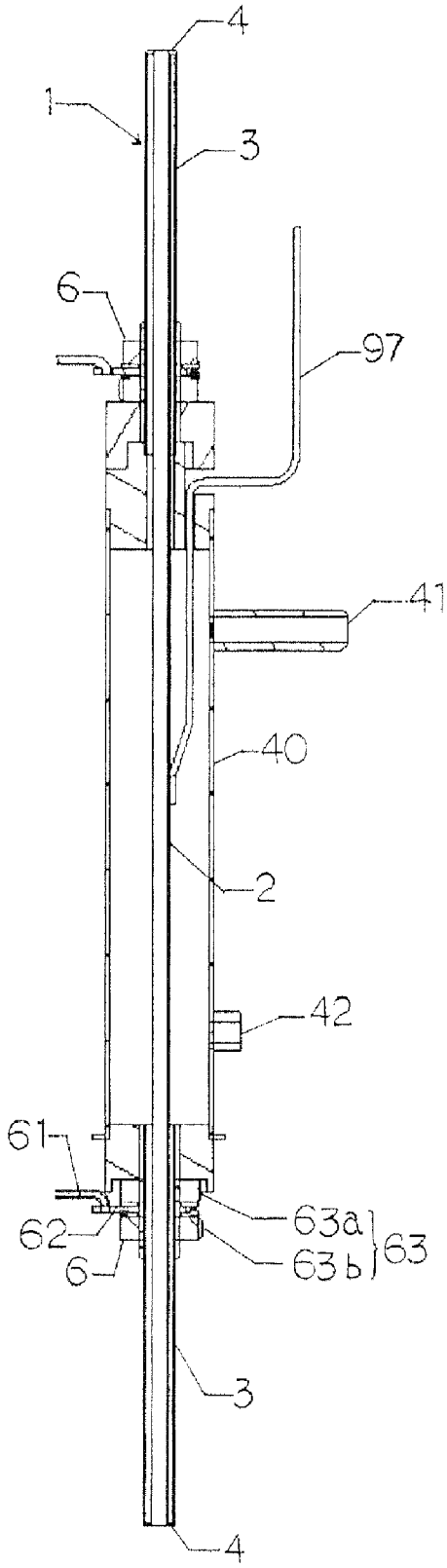
FIG. 8 is a longitudinal sectional view of Embodiment 2 of the present invention.

FIG. 8 is a longitudinal sectional view of an embodiment in which a direct heating tube of the present invention is applied to a column for a cryotrap of a gas chromatogram. In the tube 1, the first heated tube 2 had a total length of 100 mm, the first heated tube 2 had an inner diameter of 1 mm and a wall thickness of 0.05 mm, annular sheet flanges 4, 4 having a height of 0.95 mm from both end portions of the first heated tube 2 were formed, second heated tubes 3 were installed from the flange 4 concentrically with the first heated tube 2, and the second heated tubes 3 each had a length of 30 mm, an inside diameter of 3 mm, and a wall thickness of 0.05 mm. For an electrode portion 6, a conductor 61 was connected to an electrode plate 62, the second heated tube 3 was inserted through the electrode plate 62 and fixed by being supported from both sides thereof by use of a double nut 63. Thus, the electrode portion 6 was installed in a position 20 mm from the flange 4. The material for the first heated tube 2, the second heated tube 3 and the flange 4 is stainless steel. Incidentally, between the double nuts 63, 63, there is provided a middle space 40 having a cooling medium inlet 42 and a cooling medium outlet 41 as in a conventional cooling mechanism to cover the tube 1.

Embodiment 3

Figure 9:
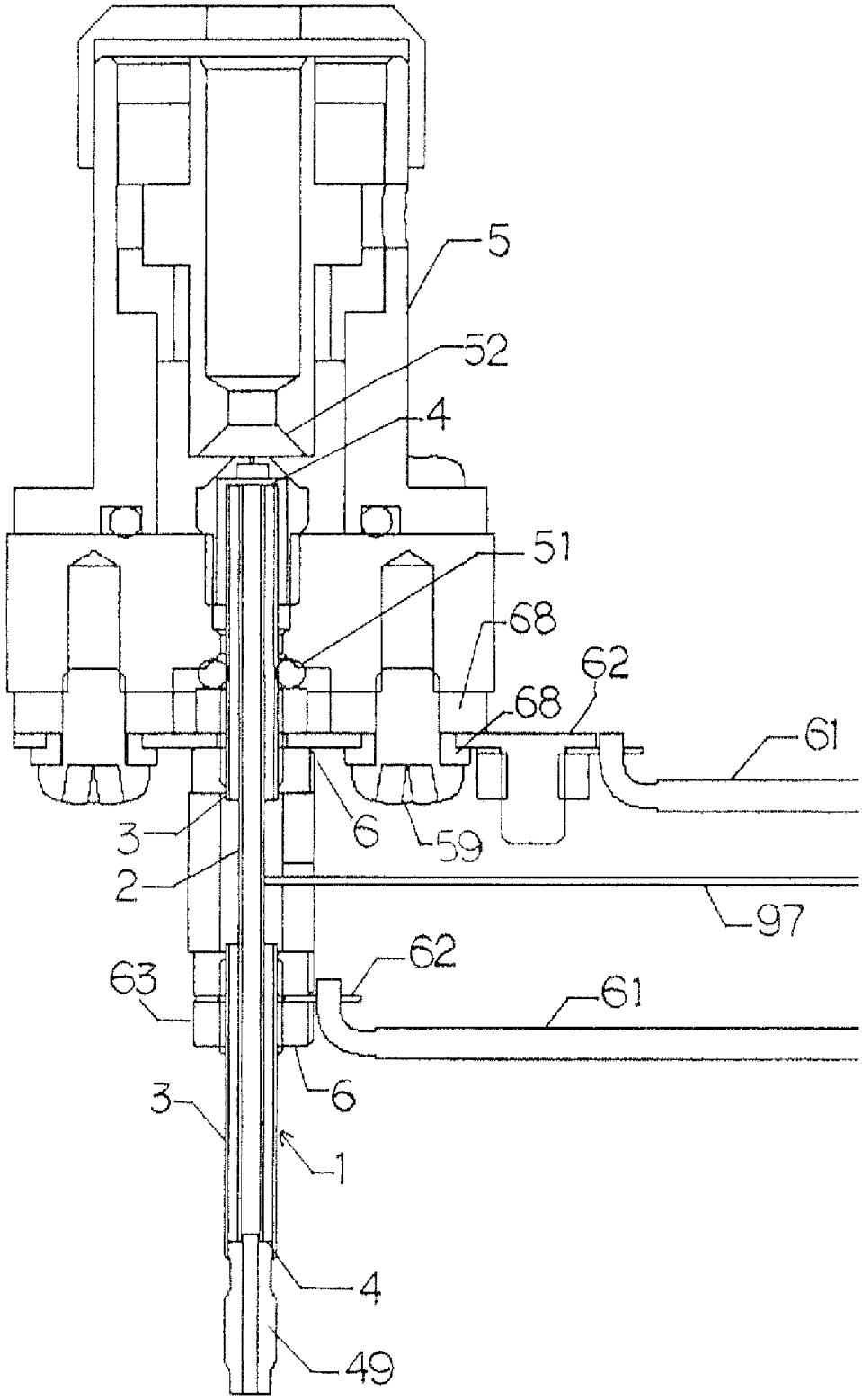
FIG. 9 is a longitudinal sectional view of Embodiment 3 of the present invention.

FIG. 9 is a longitudinal sectional view of an embodiment in which a direct heating tube of the present invention is applied to a connection between a column end of a gas chromatogram and a detector 5 (here, an FID) A heat tube having a total length of 60 mm was used as a tube 1. Flanges 4, 4 were provided at both ends of a first heated tube 2 having a total length of 60 mm and an outside diameter of 1.6 mm, and second heated tubes 3, 3 having a total length of 24 mm were provided from peripheral end portions of the flanges 4, 4 toward the center of the first heated tube 2. The material for the first heated tube 2 and the second heated tube 3 is stainless steel. An annular sheet flange 4 having a width of 0.8 mm is used as the flange 4 on the detector 5 side of the heat tube. However, in the connection between the first heated tube 2 and the second heated tube 3 on the column side, a column connection port 49 made of stainless steel is used as the flange 4. As the fabrication method of the column side end of the tube 1, it is possible to adopt a method which involves welding the second heated tube 3 to the column connection port 49 by laser welding and the like and similarly welding the first heated tube 2 to the outer side of the second heated tube 3. An electrode portion 6 on the FID 5 side was fabricated by connecting a conductor 61 to an electrode plate 62 having a hole through which the second heated tube 3 can be inserted, inserting the second heated tube 3 through the electrode plate 62, and fixing the electrode plate 62 to the FID via an insulator 68 by use of a bolt 69. An electrode portion 6 on the gas chromatography was fabricated by connecting a conductor 61 to an electrode plate 62, inserting the second heated tube 3 through an electrode plate 62, and fixing the second heated tube 3 by supporting the second heated tube 3 from both sides thereof by use of a double nut 63. The electrode portions 6, 6 were installed in a position 16 mm from the flange 4. By applying the tube 1 to the connection between the column end and a detector 5, it becomes possible to use an O-ring 51 in a connection between the tube 1, i.e., the heat tube and the detector. Thus, compared to the conventional method, it becomes possible to substantially reduce the effect of heat on an oven (not shown) of a gas chromatogram and on a collector portion 52 of an FID.

Embodiment 4

Figure 10:
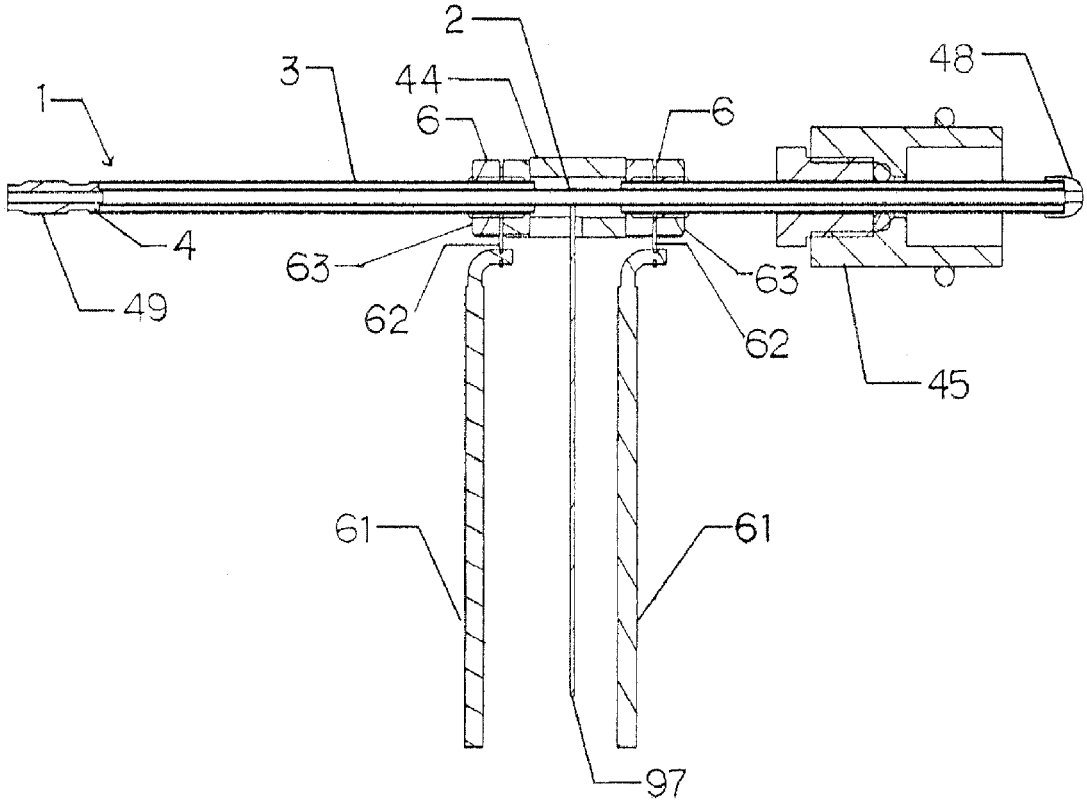
FIG. 10 is a longitudinal sectional view of Embodiment 4 of the present invention.
Figure 11:
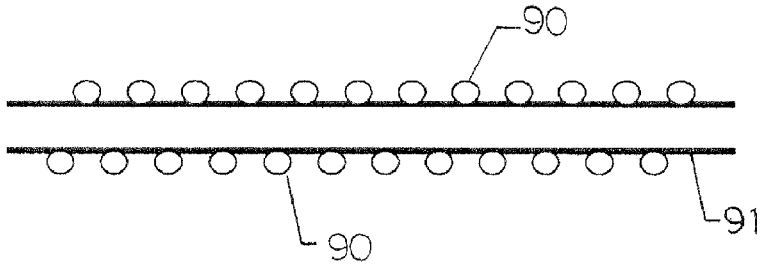
FIG. 11 is a sectional view showing a conventional example of a heated tube.
Figure 12:
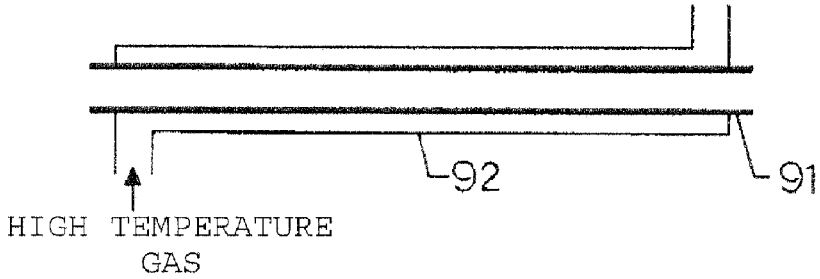
FIG. 12 is a sectional view showing a conventional example of a heated tube.
Figure 13:
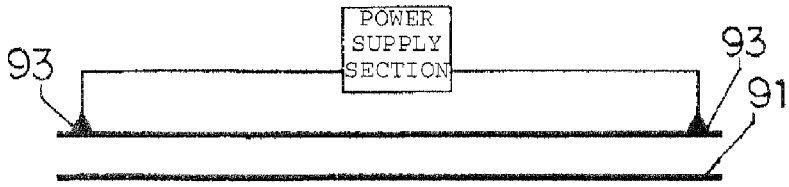
FIG. 13 is a sectional view showing a conventional example of a direct heating tube.
Figure 14:
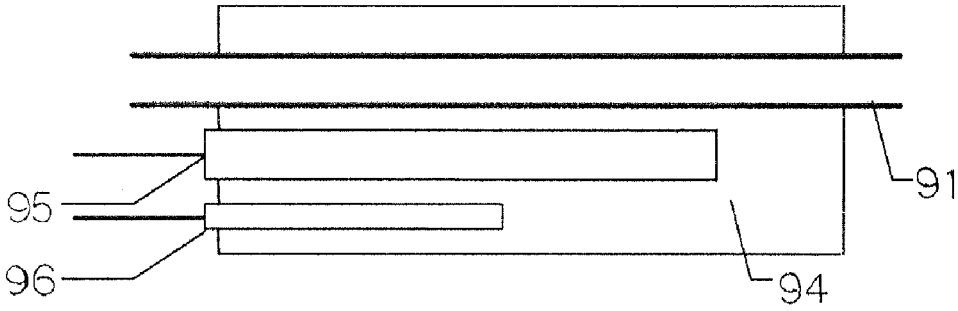
FIG. 14 is a sectional view showing a conventional example of a heated tube.
Figure 15:
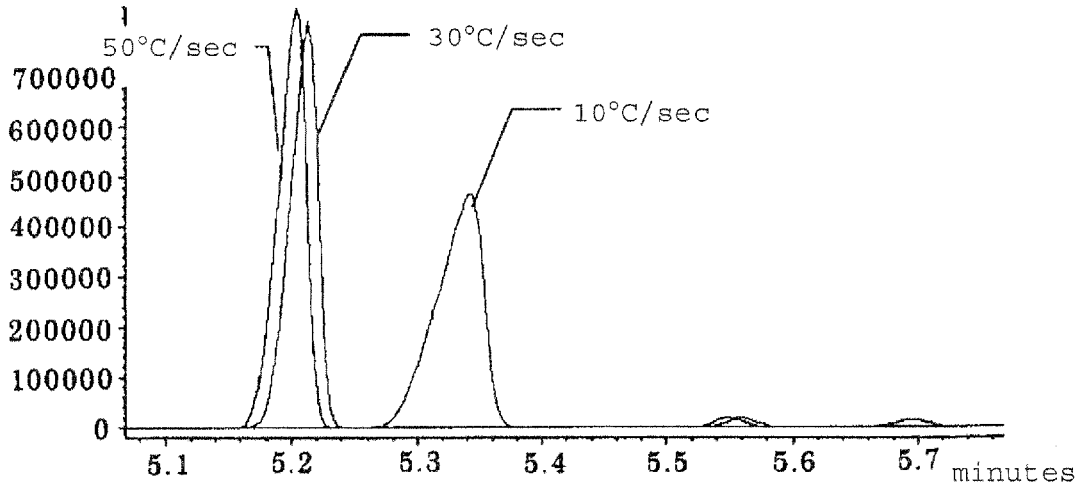
FIG. 15 is a chromatogram showing the effect of a temperature rise rate of a tube on the shape of a chromatogram peak.

FIG. 10 is a longitudinal sectional view of an embodiment in which a direct heating tube of the present invention is applied to a transfer line for GC/MS. Generally, a tube 1 or a first heated tube 2 as the transfer line for GC/MS has a total length of 150 mm to 300 mm and a second heated tube 3 has a total length of 50 mm to 100 mm. However, the length is not especially limited. In this embodiment, the first heated tube 2 has a total length of 150 mm, an outside diameter of 1.6 mm and a wall thickness of 0.15 mm. Flanges 4, 4 were provided at both ends of the first heated tube 2, and second heated tubes 3, 3 having a total length of 70 mm, an outside diameter of 3.2 mm and a wall thickness of 0.15 mm were provided in an extending manner from peripheral end portions of the flanges 4, 4 toward the center of the first heated tube 2. The material for the first heated tube 2 and the second heated tube 3 is stainless steel. An annular sheet flange 4 is used as the flange 4 on the ionization source connection port 48 side. However, in the connection between the first heated tube 2 and the second heated tube 3 on the column side, a column connection port 49 made of stainless steel is used as the flange 4. As the fabrication method of the column side end portion of the tube 1, it is possible to adopt a method which involves welding the second heated tube 3 to the column connection port 49 by laser welding and the like and similarly welding the first heated tube 2 to the outer side of the second heated tube 3. An electrode portion 6 was fabricated by connecting a conductor 61 to an electrode plate 62, inserting the second heated tube 3 through the electrode plate 62, and fixing the electrode plate 62 by use of a double nut 63, and was installed at the tube 1 center-side end of the second heated tube 3. In order to increase structural strength, a cylindrical insulator 44 was supported from both sides thereof between the electrode portions 6, 6. As in a usual transfer line for GC/MS, the electrode portion 6 is constituted by an ionization source connection port 48, a vacuum keeping flange 45, a temperature sensor 97 and the like.

The tube 1 of the present invention having a double construction is not limited to the direct heating tubes of the above embodiments, and includes various kinds of columns in which part of a capillary column is of a double construction, a heat tube, and other various direct heating tubes which require heating. The numerical values of the tube 1 are not limited to those of each of the embodiments, and it is possible to adopt various numerical values.

INDUSTRIAL APPLICABILITY

As described above, the present invention is useful as a direct heating tube which heats a fluid during the passage thereof by causing a DC current or an AC current to flow directly in the tube, such as a column which is heated in a gas chromatograph, a heat tube (a transfer line) for keeping warm a column to introduce samples from an analysis column to an ionization chamber in a heated tube at a sample injection port of a gas chromatograph or a gas chromatograph-mass spectrometer (GC/MS), and a heated tube which is used to introduce samples from the column of a gas chromatograph into a detector, such as a hydrogen flame ionization detector (FID).

What is claimed is:

1. A direct heating tube adapted for chromatography which heats a fluid during the passage of the fluid, wherein in a desired portion of the tube to be heated, a second heated tube which is connected to a first heated tube is provided outside of and fixed to the first heated tube, wherein the second heated tube and the first heated tube are directly heated by being energized via an electrode, and wherein the second heated tube additionally heats the first heated tube by radiation of heat from the second heated tube.

2. The direct heating tube according to claim 1, wherein the second heated tube is provided along a full length of the desired portion of the direct heating tube to be heated.

3. The direct heating tube according to claim 1, wherein the second heated tube is provided in both end portions of the desired portion of the direct heating tube to be heated.

4. The direct heating tube according to claim 1, wherein the second heated tube is provided in one end portion of the desired portion of the direct heating tube to be heated.

5. The direct heating tube according to claim 1, wherein an electrode portion is connected to the second heated tube.

6. The direct heating tube according to claim 5, wherein an electrode portion is connected directly to the second heated tube.

7. The direct heating tube according to claim 1, wherein a change in a wall thickness of the first heated tube and/or the second heated tube is provided along the length of the first and/or second heated tubes.

8. The direct heating tube according to claim 1, wherein the direct heating tube is a column or a heat tube.

9. The direct heating tube according to claim 5, wherein a change in a wall thickness of the first heated tube and/or the second heated tube is provided along the length of the first and/or second heated tubes.

10. The direct heating tube according to claim 9, wherein the direct heating tube is a column or a heat tube.

11. The direct heating tube according to claim 2, wherein the direct heating tube is a column or a heat tube.

12. The direct heating tube according to claim 4, wherein the direct heating tube is a column or a heat tube.

13. The direct heating tube according to claim 5, wherein the direct heating tube is a column or a heat tube.

14. The direct heating tube according to claim 7, wherein the direct heating tube is a column or a heat tube.

15. The direct heating tube according to claim 4, wherein an electrode portion is connected to the second heated tube.

16. The direct heating tube according to claim 15, wherein the direct heating tube is a column or a heat tube.

17. The direct heating tube according to claim 4, wherein a change in a wall thickness of the first heated tube, the second heated tube, or both is provided along the length of the first and/or second heated tubes.

18. The direct heating tube according to claim 1, wherein the second heated tube concentrically surrounds the first heated tube and is connected to the first heated tube by a flange, such that the direct heating tube has a double tube configuration in the region of the second heated tube.

19. The direct heating tube according to claim 1, wherein the second heated tube is fixed to the first heated tube, and the second heated tube is held outside the first heated tube at a predetermined distance.

20. A method of heating a fluid passing through a tube adapted for chromatography, wherein in a desired portion of the tube to be heated, by use of a direct heating tube which is constructed in such a manner that a second heated tube connected to a first heated tube is provided outside the first heated tube, a fluid passing through the tube is heated by connecting an electrode portion to the tube and directly heating the second heated tube and the first heated tube by being energized via an electrode, and additionally heating the first heated tube by radiation heat from the second heated tube.

* * * * *